US009010747B2

(12) United States Patent
Petermann et al.

(10) Patent No.: US 9,010,747 B2
(45) Date of Patent: Apr. 21, 2015

(54) DEVICE FOR HANDLING VALUE NOTES, COMPRISING A FEED MODULE HAVING MOVABLE RETAINING ELEMENTS

(75) Inventors: Udo Petermann, Altenbeken (DE); Paul Freitag, Steinheim (DE)

(73) Assignee: Wincor Nixdorf International GmbH (DE)

( * ) Notice: Subject to any disclaimer, the term of this patent is extended or adjusted under 35 U.S.C. 154(b) by 0 days.

(21) Appl. No.: 13/985,928

(22) PCT Filed: Feb. 17, 2012

(86) PCT No.: PCT/EP2012/052758

§ 371 (c)(1),
(2), (4) Date: Sep. 9, 2013

(87) PCT Pub. No.: WO2012/110628

PCT Pub. Date: Aug. 23, 2012

(65) Prior Publication Data

US 2014/0001703 A1 Jan. 2, 2014

(30) Foreign Application Priority Data

Feb. 17, 2011 (DE) ..... 10 2011 000 790

(51) Int. Cl.
*B65H 1/00* (2006.01)
*G07D 11/00* (2006.01)
(Continued)

(52) U.S. Cl.
CPC ..... *G07D 11/0021* (2013.01); *G07D 11/0012* (2013.01); *B65H 29/46* (2013.01); *B65H 31/10* (2013.01); *B65H 2301/4213* (2013.01); *B65H 2301/422548* (2013.01)

(58) Field of Classification Search
USPC ..... 271/145, 162, 207, 213, 214, 217–220
See application file for complete search history.

(56) References Cited

U.S. PATENT DOCUMENTS 3,767,189 A * 10/1973 Kopp ..... 271/166
4,117,314 A * 9/1978 Schisselbauer et al. ..... 235/475
(Continued)

FOREIGN PATENT DOCUMENTS

DE 3028151 A1 4/1981
DE 3917699 A1 12/1989
(Continued)

OTHER PUBLICATIONS

English Translation of the Written Opinion for PCT/EP2012/052758, mailed Jul. 17, 2012; ISA/EP.
(Continued)

*Primary Examiner* — Prasad Gokhale
(74) *Attorney, Agent, or Firm* — Harness, Dickey & Pierce, P.L.C.

(57) ABSTRACT

The invention relates to a device (10) for handling notes of value, comprising a supply module (1000) for supplying notes of value to a value note receiving region (1004) of a value note cassette (16*a* to 16*d*), wherein the notes of value are receivable in a value note receiving region (1004) in the form of a value note stack (1006). The supply module (1000) comprises at least one retaining element (1008, 1010), which, in a retaining position, contacts a front-side note of value of the value note stack (1006) and holds the value note stack (1006) in the value note receiving region (1004). In a supply position, the retaining element (1008, 1010) is arranged such that a note of value is suppliable to the value note stack (1006).

13 Claims, 6 Drawing Sheets

(51) Int. Cl.
*B65H 29/46* (2006.01)
*B65H 31/10* (2006.01)

(56) References Cited

U.S. PATENT DOCUMENTS

| | | | | | |
|---|---|---|---|---|---|
| 4,139,191 | A * | 2/1979 | Muller | 271/189 |
| 5,000,322 | A | 3/1991 | Goi | |
| 5,314,177 | A * | 5/1994 | Anma | 271/3.04 |
| 6,095,518 | A * | 8/2000 | Allmendinger et al. | 271/215 |
| 6,131,809 | A | 10/2000 | Drescher et al. | |
| 6,398,000 | B1 | 6/2002 | Jenrick et al. | |
| 7,059,599 | B2 * | 6/2006 | Lewis | 271/213 |
| 7,954,816 | B2 | 6/2011 | Freitag et al. | |
| 8,340,391 | B2 | 12/2012 | Petermann | |
| 2002/0175463 | A1 | 11/2002 | Abe et al. | |
| 2003/0071408 | A1 * | 4/2003 | Quadalti | 271/145 |
| 2010/0213023 | A1 | 8/2010 | Freitag et al. | |
| 2011/0254214 | A1 * | 10/2011 | Walsh | 270/45 |
| 2012/0211935 | A1 | 8/2012 | Petermann et al. | |

FOREIGN PATENT DOCUMENTS

| | | | | |
|---|---|---|---|---|
| DE | 10-2009-003973 | A1 | 7/2010 | |
| EP | 1503350 | A1 | 2/2005 | |
| FR | 1593464 | A | 5/1970 | |
| GB | 2135493 | A | 8/1984 | |
| GB | 2220782 | A | 1/1990 | |
| GB | 2247097 | A | 2/1992 | |
| JP | 55130447 | A * | 10/1980 | B65H 29/26 |
| JP | 02158560 | A * | 6/1990 | B65H 29/40 |
| WO | WO-03-077209 | A2 | 9/2003 | |

OTHER PUBLICATIONS

International Preliminary Report on Patentability for PCT/EP2012/052758 mailed Aug. 29, 2013 with English translation (20 pages).

* cited by examiner

DEVICE FOR HANDLING VALUE NOTES, COMPRISING A FEED MODULE HAVING MOVABLE RETAINING ELEMENTS

CROSS-REFERENCE TO RELATED APPLICATIONS

This application is a National Stage of International Application No. PCT/EP2012/052758, filed Feb. 17, 2012, and published in German as WO 2012/110628 A1 on Aug. 23, 2012. This application claims the benefit and priority of German Application No. 10 2011 000 790.3, filed Feb. 17, 2011. The entire disclosures of the above applications are incorporated herein by reference.

BACKGROUND

This section provides background information related to the present disclosure which is not necessarily prior art.

TECHNICAL FIELD

The invention relates to a device for handling notes of value comprising at least one cassette receiving region, in which a value note cassette for storing notes of value is received. By means of a supply module, notes of value are suppliable to a value note receiving region of the value note cassette. Herein, the notes of value are received in the value note receiving region in the form of a stack of notes of value. The supply module comprises a supply region for supplying the notes of value to the value note receiving region and at least one retaining element, which, in a retaining position, contacts the note of value arranged at the front side of the value note stack facing the supply region and holds the value note stack in the value note receiving region. In a supply position, the retaining element is arranged such that at least one note of value arranged in the supply region is suppliable to the value note receiving region.

DISCUSSION

The device for handling notes of value is particularly an automatic cash safe, an automatic cash system and/or an automated teller machine, such as a cash deposit machine for depositing banknotes and checks. After their authenticity has been verified, the value notes inserted are transported into a safe and deposited in value note cassettes arranged in cassette receiving regions of the safe. The supply of the notes of value to be deposited to the value note cassettes is effected via supply modules.

In known supply modules, the retaining elements are mounted to be pivotable around a rotational axis. Via a supply element, the notes of value arranged in the supply region are supplied to the value note receiving region in the direction of the stack. While moving these notes of value to be supplied in the direction of the stack, the contact regions of the retaining elements are pivoted by rotation of the retaining elements around the rotational axis in the direction of the value note stack received in the value note cassette. Herein, the retaining elements in turn move the value note stack against the spring force of a spring arranged at the front face of the value note stack facing away from the supply region and thus press the value note stack further into the value note receiving region of the value note cassette. The contact regions of the retaining elements herein are pivoted to such an extent that the notes of value to be supplied are arranged at the front side of the stack facing the supply region and the retaining elements are arranged laterally of the stack of notes of value.

What is problematic about such supply module is that, for supplying the notes of value, the entire stack of notes of value has to be moved by the length of the contact regions of the retaining elements in the direction of the stack, such that the maximally available receiving volume of the value note receiving region is reduced by this corresponding length, such that therefore the space present in the value note cassette cannot be optimally used.

SUMMARY OF THE INVENTION

It is an object of the invention to specify a device for handling notes of value, by means of which a maximum number of notes of value is receivable in a value note cassette without changing the dimensions of the value note cassette.

Owing to the retaining element being moved along a movement path obliquely to the stacking direction, in which a note of value to be supplied to the value note stack is transported from the supply region into the value note receiving region, it is achieved that upon supply of a further value note, the value note stack present in the value note cassette does not have to be pressed further into the value note receiving region, such that the entire value note receiving region is in fact available for receiving notes of value, whereas in prior art, the end region facing the supply region is not available for receiving notes of value at least along the contact region of the retaining element. Thus, with given dimensions of the value note cassette and the value note receiving region, the maximum receiving volume is obtained.

In the supply position, the retaining element in particular is displaced to such an extent that it does no longer contact the value note stack, such that the notes of value arranged in the supply region and to be supplied can be supplied to the value note receiving region in an unobstructed way. The notes of value to be supplied are in particular stacked to form a further value note stack and are supplied jointly as a value note stack to the value note receiving region. Thus, as many notes of value as possible are suppliable at one go to the value note receiving region, such that it is possible to quickly supply a great number of notes of value. Alternatively the notes of value can also be supplied one by one.

In an alternative embodiment of the invention, the supply module forms part of the value note cassette. In such case, the supply module is in particular arranged within a housing of the value note cassette.

In an alternative embodiment, the value note cassette and the supply module can also be units separate from one another. In particular, the supply module does not form part of the value note cassette and is arranged outside of the housing of the value note cassette. Thus it is achieved that the supply module does not have to be removed jointly with the value note cassette, such that the value note cassette is constructed in a simple and inexpensive way.

By means of the retaining element, in particular the value note receiving region is separated from the supply region when the retaining element is arranged in the retaining position. When the retaining element is arranged in the supply position, the notes of value can be transported from the supply region into the value note receiving region.

The stacking direction is oriented approximately parallel to the normal vector of the plane defined by the value note arranged at the front side of the value note stack. In particular, thus a value note stack that is to be supplied and that is arranged in the supply region, is supplied to the value note stack received in the value note receiving region such that after having been supplied, the two value note stacks contact each other with their front sides facing each other and form a combined single value note stack.

The retaining element is in particular mounted such that it is translationally movable, so that by means of a movement that can easily be effected, the retaining element is movable between the retaining position and the supply position such that to this end, the value note stack present in the value note cassette does not have to be altered in its position.

At least a partial region of the movement path is preferably oriented in a direction approximately transverse to the stacking direction. This partial region is in particular the end region of the movement path directed toward the retaining position. Thus, the retaining element is moved in this partial region transversely to the stacking direction via the movement path, whereas the remaining movement path is formed to be angled in particular with regard to this partial region. Owing to this, a very compact structure of the supply module is achieved as the supply elements do not have to be moved transversely to the stacking direction over their entire length, but can be moved in a space-saving way due to the movement path having a curved form.

The retaining element in particular is mounted in a slider predefining the movement path and guiding the retaining element while it is being moved. Thus, a safe and targeted guiding of the retaining element as well as a space-saving structure of the supply module are obtained.

The device preferably comprises a drive unit for moving the retaining element along the movement path from the retaining position into the supply position and/or from the supply position into the retaining position. Such drive unit in particular has an electric motor and/or a lifting magnet.

Further, the supply module preferably has a supply element for supplying at least one note of value arranged in the supply region to the value note stack arranged in the value note receiving region as well as a further drive unit moving the supply element for supplying the at least one note of value arranged in the supply region translationally in the stacking direction and thus pressing upon the note of value to be supplied. Thus, it is achieved in a simple way that the note of value arranged in the supply region is supplied to the value note stack. Further, thus a space-saving structure of the supply module is achieved.

Herein, the supply element is in particular moved in the direction of the stacking direction to such an extent that the contact surface of the supply element, which upon supply is in contact with the surface of the note of value facing away from the value note receiving region, is arranged in the contact plane, in which the retaining element and the front-side note of value of the value note stack received in the value note receiving region and facing the supply region contact each other, when the retaining element is arranged in the retaining position. It is not necessary to move the retaining element further into the value note receiving region.

In an alternative embodiment of the invention, the drive unit and the further drive unit can also be the same drive unit, such that only one drive unit is required for moving the retaining element and the supply element.

Further, it is advantageous that the value note cassette comprises a pressure element arranged at an end region of the value note receiving region located opposite the supply region. The pressure element contacts the note of value arranged at the front side of the value note stack facing away from the supply region and presses the value note stack against the retaining element arranged in the retaining position. Thus it is achieved that the notes of value of the value note stack are held together and that the value note stack on the whole is being kept in a preset position. The pressure element in particular comprises a spring, which is all the more biased the more notes of value are contained in the value note stack.

Herein, the pressure element in particular is oriented such that it presses the value note stack against the retaining element in a direction opposite to the stacking direction. Thus, the force applied by the pressure element is oriented opposite to the force applied by the supply element.

In a preferred embodiment of the invention, a control unit at first controls the further drive unit such that this further drive unit moves the supply element in the stacking direction to such an extent that it presses the note of value to be supplied or the notes of value to be supplied, respectively, against the retaining element. Subsequently, the control unit controls the one drive unit such that the one drive unit moves the retaining element from the retaining position into the supply position. Then, the control unit controls the further drive unit such that this further drive unit transports the note of value to be supplied or the notes of value to be supplied, respectively, further in the stacking direction from the supply region into the value note receiving region pressing it against the front side of the value note stack arranged in the value note receiving region. Herein, the supply element presses the value note stack in the stacking direction in particular against the force of the pressure element. While the notes of value are being supplied, when the retaining element is arranged in the retaining position, the value note stack can meanwhile be retained by the supply element in the value note receiving region.

The notes of value that at first are pressed against the retaining element still arranged in the retaining position by the supply element, contact the retaining element in particular on the side opposite to the side, against which the pressure element presses the value note stack against the retaining element. When the retaining element is moved from the retaining position into the supply position, the pressure element and, respectively, the supply element, move the value note stack and, respectively, the notes of value to be supplied further toward each other, wherein the value note stack and/or the note, respectively the notes of value herein can be moved into the space that before had been occupied by the retaining element.

After supply of the note of value to be supplied or the notes of value to be supplied, respectively, the control unit controls the further drive unit in particular such that the latter moves the supply element in a direction opposite to the stacking direction back to an initial position, such that the supply region is vacant again so that further notes of value to be supplied thereto can be arranged therein. Further, after supply of the note of value to be supplied or the notes of value to be supplied, respectively, the control can control the one drive unit such that the latter moves the retaining element from the supply position into the retaining position, such that the retaining element again holds the value note stack supplemented by the note of value to be supplied or the notes of value to be supplied, respectively, and received in the value note receiving region in the value note receiving region.

In a particularly preferred embodiment of the invention, first the retaining element is moved into the retaining position and then the supply element is moved away from the stack into the initial position in a direction opposite to the stacking direction. Thus it is achieved that the value note stack arranged in the value note receiving region is held in its position via any one of the two elements at any time.

According to an alternative embodiment of the invention it is possible that the retaining element is not moved by a drive unit from the retaining position into the supply position and from the supply position into the retaining position but by an elastic element, for example a spring, which is biased in one of the two positions and which is only moved into the other position by the one drive unit. Moving it from the other position into the biased position in this case is only effected by the elastic element.

It is also possible that the supply element is biased in one of the two positions and is moved into the other position by the further drive unit. Here again, for biasing, an elastic element, for example a spring, can be made use of.

Upon supply of the note of value to be supplied or the notes of value to be supplied, respectively, the further drive unit moves the supply element in particular such that it presses the note or notes of value to be supplied with a supply force against the retaining element. This supply force is preset such that the retaining element is moved from the retaining position into the supply position by the supply force. Subsequently, it is not necessary to provide a drive unit for moving the retaining element since it can be moved from the retaining position into the supply position passively via the supply element. In this embodiment, the retaining element is biased via an elastic element, for example a spring, in the retaining position, such that, when no supply force is applied any more to the retaining element, the latter is moved back into the retaining position by the elastic element and retains the value note stack that has been supplemented by the note of value to be supplied or the notes of value to be supplied, respectively, and that is being received in the value note receiving region, in the value note receiving region.

The supply force is in particular preset such that it is greater than the pressure force, which is applied by the pressure element to press the value note stack against the retaining element.

While the note of value to be supplied or, respectively, the notes of value to be supplied are supplied from the supply region into the value note receiving region, the retaining element is held in the supply position in particular via the contact with a longitudinal surface of the value note stack. After the supply element has pressed the value note stack in the direction of the pressure element against the pressure force thereof to such an extent that the front-side note of value of the value note stack facing the supply region is arranged behind the contact surface, in which the retaining element arranged in the retaining position would contact the value note stack, thus, the retaining element is automatically moved from the supply position into the retaining position, such that it holds the value note stack in the value note receiving region.

In a particularly preferred embodiment of the invention, the supply module comprises at least one further retaining element, which in a retaining position, contacts the note of value arranged at the front side of the value note stack facing the supply region and holds the value note stack in the value note receiving region. In the supply position, the further retaining element is arranged such that at least one note of value arranged in the supply region is suppliable to the value note stack. The further retaining element is movable along a further movement path from the retaining position into the supply position and from the supply position into the retaining position. This further movement path is oriented in a direction oblique to the stacking direction, in particular transverse to the stacking direction. By providing two retaining elements it is achieved that the value note stack is reliably retained in the value note receiving region. The retaining elements are in particular arranged at the sides of the value note stack opposite each other, such that it is retained over approximately its entire width.

The further retaining element and the one retaining element are in particular identically constructed. In an alternative embodiment of the invention, the retaining elements can also be constructed differently. In particular the lengths of the two retaining elements can differ. Further, also the movement paths along which the two retaining elements are moved can be formed to be identical or different. Moving the two retaining elements can be effected via the same or via different drive units.

In a particularly preferred embodiment of the invention, the lengths of the retaining elements and the arrangement of the two retaining elements are selected such that, when both of the retaining elements are arranged in the retaining position, a clearance is formed between the ends of the two retaining elements facing each other, which is greater than the width of the supply element, such that the supply element can protrude through the two retaining elements arranged in the retaining position. Thus, it is achieved that, after supply of the notes of value to the value note stack received in the value note receiving region, this value note stack a priori can still be held by the supply element until the two retaining elements are arranged in the retaining position and such that only then, the supply element has to be moved into the initial position. Thus, the value note stack is uninterruptedly held in the value note receiving region.

The value note cassette is in particular a commercially available cash box. Owing to a supply module of the device that is designed according to the embodiments described above and in which the cash box is inserted, a greater number of notes of value can be received therein without any constructive change of the cash box. The notes of value are in particular banknotes and/or checks.

BRIEF DESCRIPTION OF THE DRAWINGS

The drawings described herein are for illustrative purposes only of selected embodiments and not all possible implementations, and are not intended to limit the scope of the present disclosure.

Further features and advantages of the invention will become apparent from the following description which outlines the invention by means of embodiments with reference to the accompanying figures.

The figures comprise:

Figure 1:
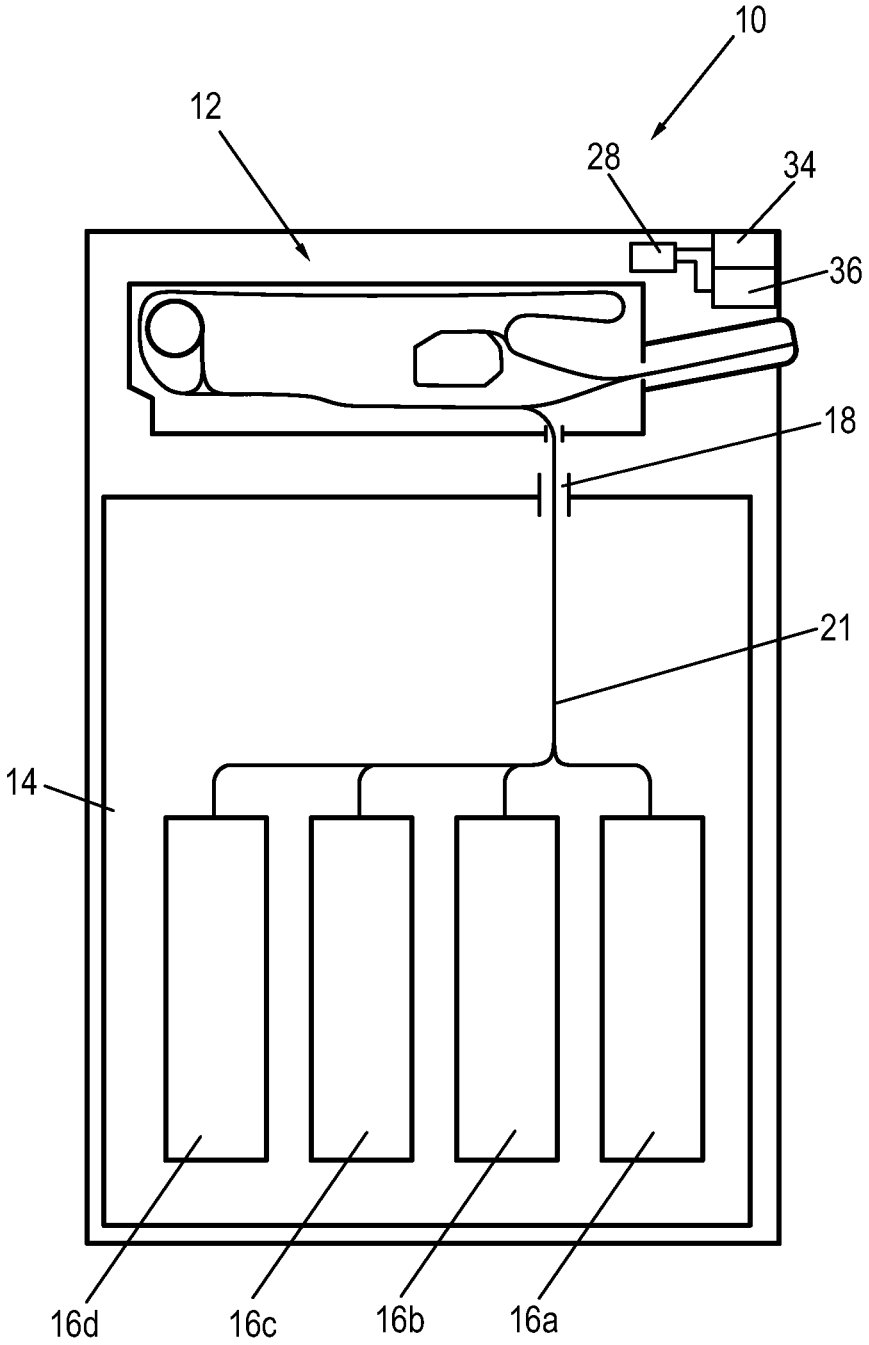
Figure 2:
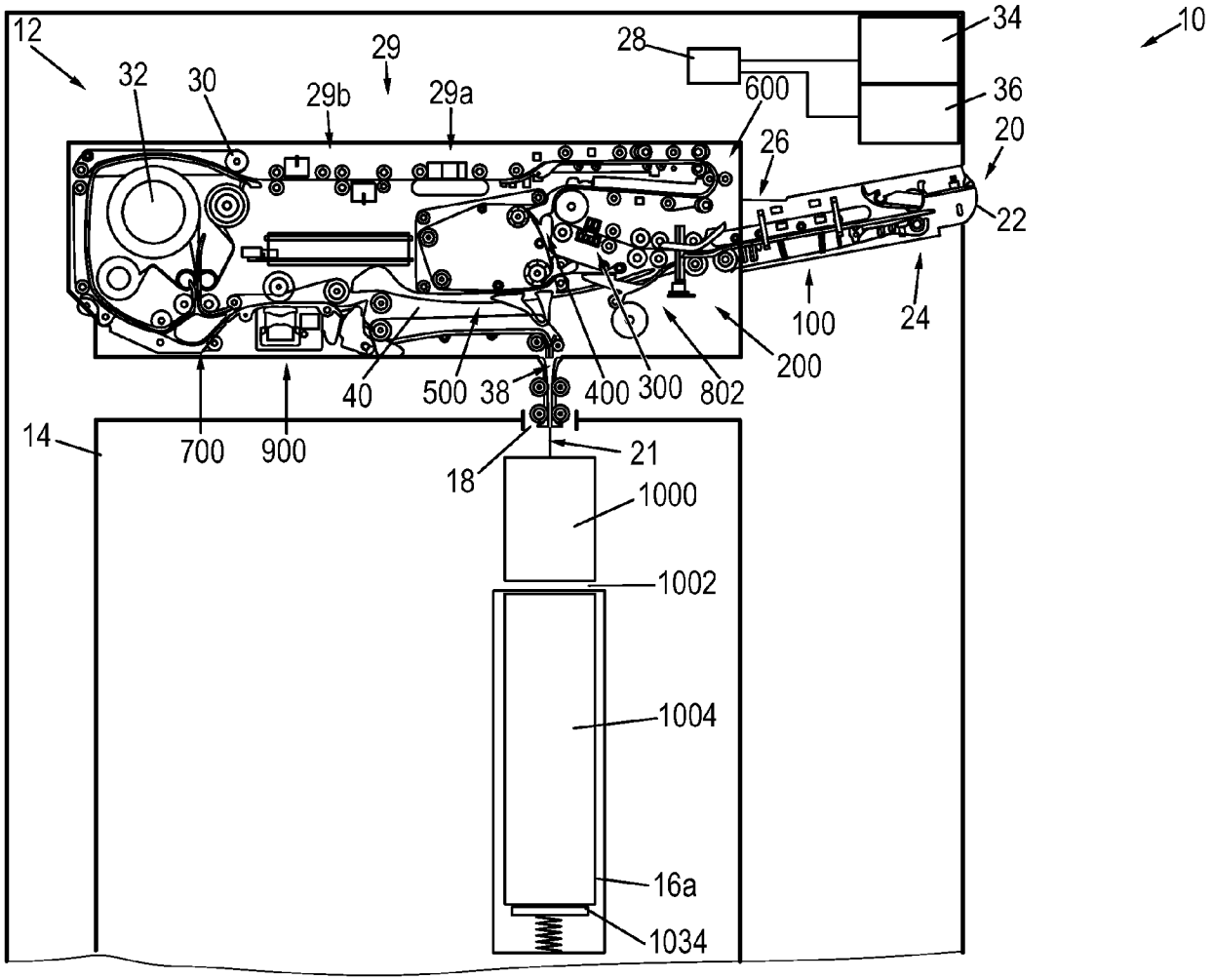
Figure 3:
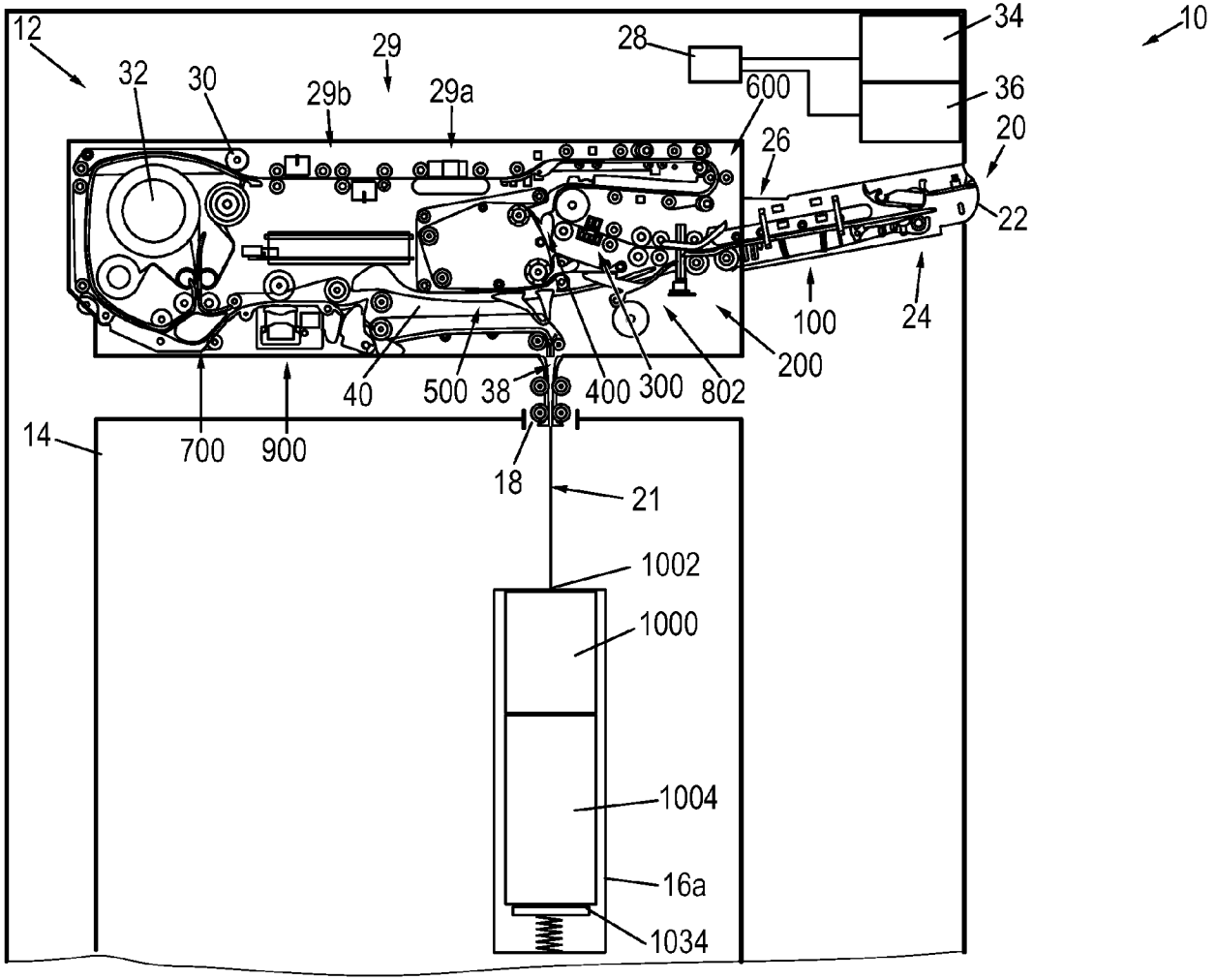
Figure 4:
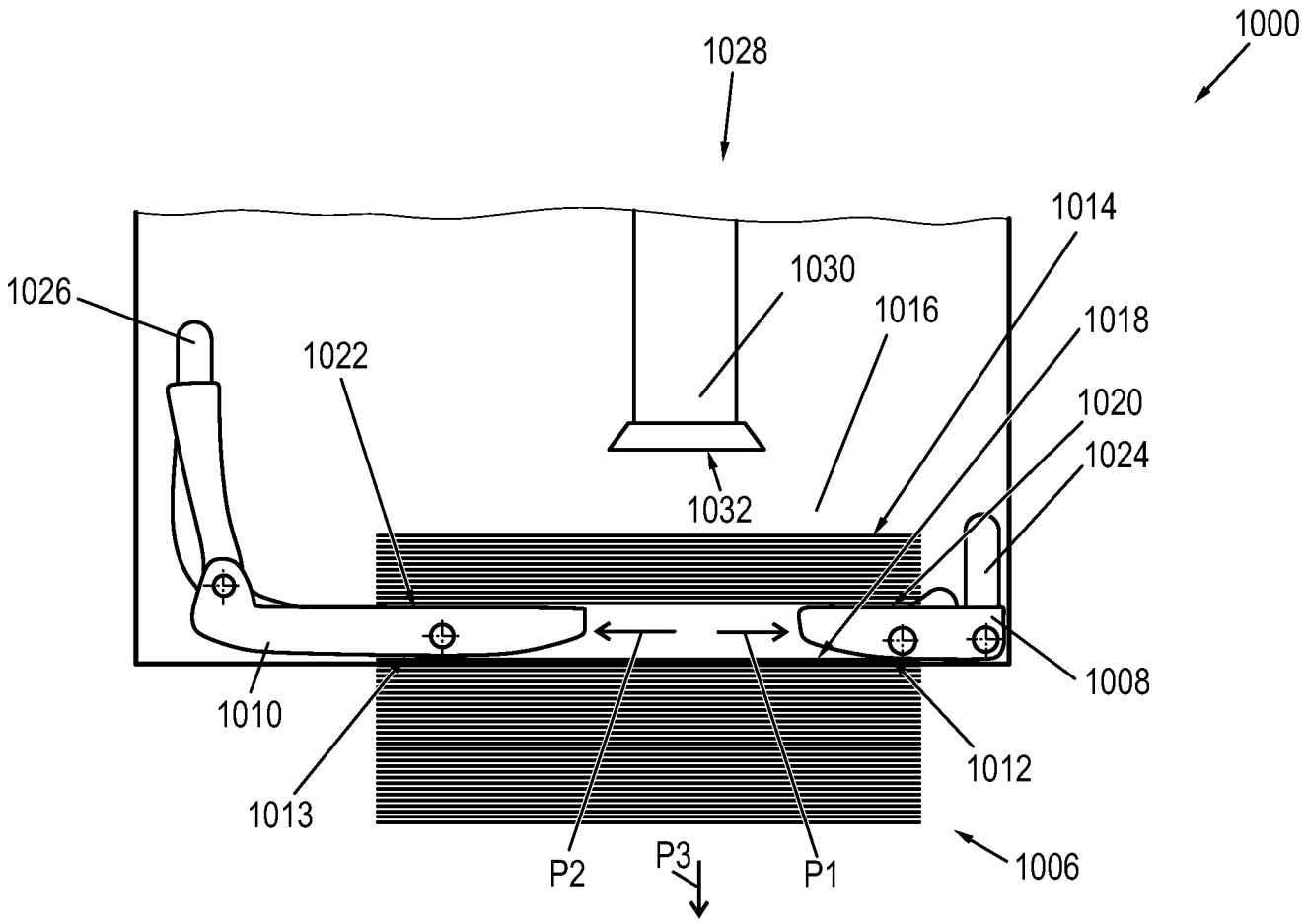
Figure 5:
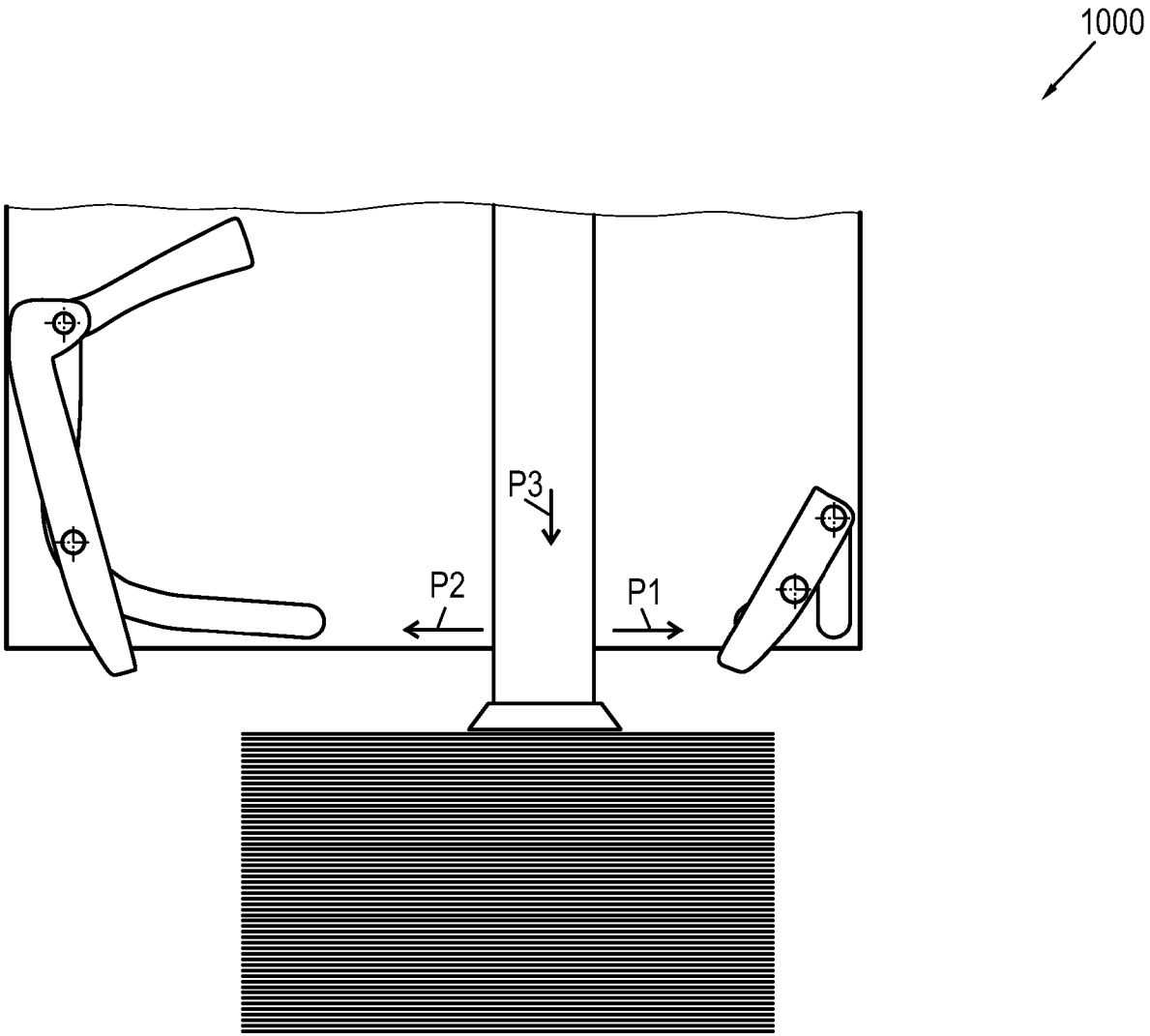
Figure 6:
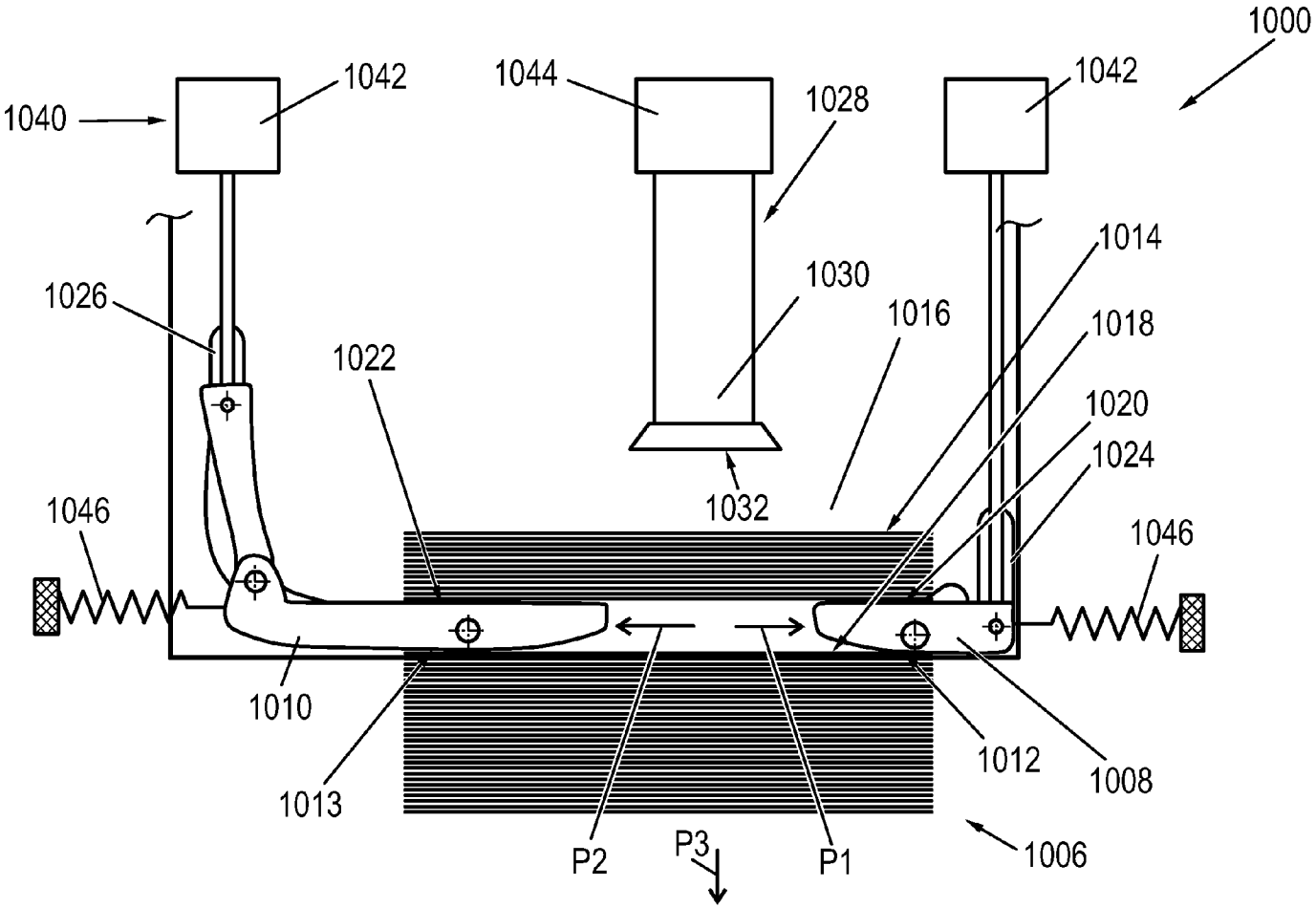

FIG. 1 showing a schematic view of a device for handling notes of value;

FIG. 2 showing a schematic view of a head module of the device according to FIG. 1 corresponding to a first embodiment;

FIG. 3 showing a schematic view of a head module of the device according to FIG. 1 corresponding to a second embodiment;

FIG. 4 showing a schematic view of a supply module of the device according to FIGS. 1 and 2 in the first operating condition;

FIG. 5 showing a schematic view of the supply module according to FIG. 3 in a second operating condition; and FIG. 6 showing a schematic view of a supply module of the device.

Corresponding reference numerals indicate corresponding parts throughout the several views of the drawings.

DETAILED DESCRIPTION OF THE PREFERRED EMBODIMENTS

Example embodiments will now be described more fully with reference to the accompanying drawings.

FIG. 1 is a schematic view of a device 10 for handling notes of value. The device 10 is particularly an automatic cash safe, an automatic cash system and/or an automated teller machine, such as a cash deposit machine for depositing banknotes and checks.

The device 10 comprises a head module 12 and a safe 14. The structure of the head module 12 is described in more detail in connection with FIG. 2. Within the safe 14, four value note cassettes 16*a* to 16*d* are arranged in which the notes of value can be received. Herein, in particular one of the value note cassettes 16*a* to 16*d* is provided for receiving checks whereas the other three value note cassettes 16*a* to 16*d* are provided for receiving banknotes. The reception of banknotes is particularly effected such that these are of a single variety, i.e. such that in every value note cassette 16*a* to 16*d* only banknotes of the same denomination are received. Alternatively the reception can be effected as a mixed storage, i.e. that in one value note cassette 16*a* to 16*d* notes of value of different denominations are miscellaneously received. In an alternative embodiment, more than four or less than four, in particular two, value note cassettes 16*a* to 16*d* can also be provided in the safe 14. In particular, a so-called reject cassette can be provided, in which notes of value are received that are suspect of being counterfeit and/or are damaged. In a preferred embodiment, two value note cassettes 16*a* to 16*d*, namely one for receiving checks and one for receiving banknotes, are provided.

Herein, the notes of value can either be received in the value note cassettes 16*a* to 16*d* in a value note receiving region in a stacked manner or be stored between two film tapes wound up on a drum storage. Use can also be made of different types of value note cassettes within the safe 14.

In the present embodiment, the device 10 can be formed to be a mere deposit device for merely receiving notes of value. Alternatively it can also be formed to be a recycling device into which notes of value can be both inserted and re-dispensed.

The safe 14 has a transfer slot 18 through which the notes of value are supplied to the safe 14 from the head module 12. From the transfer slot 18, the notes of value are transported to the value note cassettes 16*a* to 16*d* via a transport unit identified with reference sign 21.

FIG. 2 is a schematic view of a head module 12 according to FIG. 1 corresponding to a first embodiment. The head module 12 has an input and output unit 20 via which the notes of value are inserted in the form of a stack of notes of value. Further, this input and output unit 20 may serve to re-dispense individual notes of value and/or stacks of notes of value to the operator of the device 10. The input and output unit 20 in particular has a so-called shutter 22 via which an opening for supplying and dispensing the notes of value can be opened and shut.

By means of a transport unit 24, a stack of notes of value inserted via the input and output unit 20 is transported to a first alignment unit 100. By means of the first alignment unit 100, the notes of value of the stack of notes of value are aligned to have a preset orientation or at least the orientation of a portion of the notes of value of the stack of notes of value is changed such that it approximates the preset orientation. By means of a transport unit 26, the aligned stack of notes of value is supplied to a separating unit 200 that separates the notes of value of the stack of notes of value and supplies the separated notes of value to a first sensor unit 300.

The first sensor unit 300 comprises an image capturing unit by means of which at least one image with a representation of this note of value is taken of each supplied note of value. Dependent on the representation of the note of value in the image, a control unit 28 of the device 10 determines at least one feature of the note of value and, dependent on this feature, classifies the note of value into checks, banknotes of a preset currency and other sheet-shaped media. Other sheet-shaped media can for example be notes of value of a currency differing from the preset currency and/or other sheet-shaped media erroneously inserted by the operator of the device. For example such media can be business cards or account statements. The preset currency in particular is such currency which is to be handled by the device 10 and particularly to be received in the value note cassettes 16*a* to 16*d*.

Those notes of value that are classified to be neither checks nor banknotes of the preset currency are transported via a sorting gate 400 into a second intermediate storage 500 for intermediate storage of sheet-shaped media to there be intermediately stored preferably as a second stack of notes of value. On the other hand, the checks and banknotes of the preset currency are supplied to a second alignment unit 600 via sorting gate 400. By means of this second alignment unit 600, the checks are aligned to have a first preset nominal orientation and the banknotes are aligned to have a second nominal orientation differing from the first nominal orientation. In particular, a plurality of different nominal orientations is preset for banknotes having different denominations and the second alignment unit 600 aligns the notes of value in differing preset nominal orientations not only depending on whether they are checks or banknotes but additionally also depending on the denomination of the banknotes.

The aligned notes of value are subsequently supplied to a second sensor unit 29 by means of which the authenticity of the banknotes is determined and by means of which the magnetic information of the checks is read out. The sensor unit 29 comprises a banknote sensor unit 29*a*, by means of which the authenticity of the banknotes is verified, and a check sensor unit 29*b*, by means of which the authenticity of the checks is verified and the information printed onto the checks is read out. Together with the control unit 28, the first sensor unit 300 and the second sensor unit 29 in particular form a non-counterfeit money and check detection module. Upon determination of the authenticity of the banknotes and/or checks, preferably also information determined by the sensor unit 300 is taken into account.

Subsequently, the notes of value are transported in the direction of a second sorting gate 700 by means of further transport elements, one of which by way of example is referred to by reference numeral 30. Via the second sorting gate 700, all notes of value of the stack of notes of value previously inserted, which have been classified to be checks or banknotes of the preset currency, are at first supplied to a first intermediate storage 32 and are intermediately stored therein. The intermediate storage 32 is particularly formed to be a drum storage, in which the notes of value to be received are received wound up between two film tapes. After all of the notes of value of the inserted stack of notes of value have been received in the first intermediate storage 32 or the second intermediate storage 500, via a display unit 34 at least one piece of information about the notes of value received in the first intermediate storage 32 and/or the second intermediate storage 500 is delivered to the operator. This information in particular comprises information about the number of notes of value inserted and/or about the value of the amount of the denominations of the inserted notes of value that are received in the first intermediate storage 32. Further, the operator is particularly requested to enter a confirmation information via an input unit 36.

If no confirmation information is input via the input unit 36 by the operator within a preset time interval after request and/or if the user makes a negative input, then the notes of value contained in the first intermediate storage 32 are transported away from this storage and are supplied to a stacking unit 40, by means of which a first stack of notes of value is formed from all notes of value contained in the first intermediate storage 32. Further, the second stack of notes of value contained in the second intermediate storage 500 is taken out of the second intermediate storage 500. Both the first stack of notes of value and the second stack of notes of value are supplied to a stack combining unit 802 by means of which one single combined stack of notes of value is formed out of the first and the second stack of notes of value. This combined stack of notes of value is subsequently re-dispensed to the operator via the input and output unit 20.

If, on the other hand, the user inputs the confirmation information within the preset time interval after the respective request, then the second stack of notes of value is removed from the second intermediate storage 500 and is delivered to an operator via the input and output unit 20.

On the contrary, the notes of value intermediately stored in the first intermediate storage 32 are supplied along a transport path 38 to the safe 14 and are received in the value note cassettes 16*a* to 16*d*. The checks intermediately stored in the first intermediate storage 32 are voided in a predetermined printing area of the check by printing a void printing image thereupon prior to transport of the checks to the safe 40. To this end, a printing unit 900 for imprinting the checks is provided between the second sorting gate 700 and the transport path 38. Herein, via the sorting gate 700, the checks are supplied to the printing unit 900 in such a way that the printing area, onto which the void information is be printed, is oriented toward the print head of the printing unit 900 such that this print head is able to print the void printing image onto this printing area.

The head module 12 described earlier is used to achieve that in a device 10 checks and banknotes can be handled jointly and can be supplied to the device 10 even though arbitrarily mixed in a stack. This results in a particularly high user comfort for the operator of the device 10, who therefore does neither have to effect any manual pre-sorting of the notes of value into checks and banknotes nor any presetting, as applicable to known devices, as to the kind of notes of value.

Along the transport path 38, the notes of value removed from the first intermediate storage 32 are transported to the transfer slot 18 to be supplied to the safe 14 therethrough. Here, the notes of value are received in the value note cassettes 16*a* to 16*d*, wherein in FIG. 2, only one of these value note cassettes 16*a* to 16*d*, namely value note cassette 16*a*, is illustrated. In the following, the supply of the notes of value to be received in the value note cassettes 16*a* to 16*d* is described by way of example with regard to value note cassette 16*a*. The supply of notes of value to the other value note cassettes 16*b* to 16*d* can be effected in the same or in a different way.

The notes of value to be supplied to the value note cassette 16*a* are transported from the transport unit 21 to a supply module 1000, which, via a slot 1002, supplies the notes of value in the form of a supply stack 1014 to the value note cassette 16*a*. The notes of value received in the value note cassette 16*a* are stored in a value note receiving region 1004 of the value note cassette 16*a* in a stapled form.

FIG. 3 is a schematic view of the head module 12 according to FIG. 1 corresponding to a second embodiment. This second embodiment differs from the first embodiment in that, in the case of the second embodiment, the supply module 1000 forms part of the value note cassette 16*a* and is thus removable from and suppliable to the device 10 jointly with the value note cassette 16*a*.

The descriptions outlined in the following with regard to FIGS. 4 and 5 refer to both embodiments, which means both to the supply module 1000 integrated into the value note cassette 16*a* and to the type of construction of the value note cassette 16*a* and the supply module 1000 being separate from each other.

FIG. 4 is a schematic view of the supply module 1000 in a first operating condition. Further, a part of the value note stack 1006 received in the value note receiving region 1004 is illustrated.

The supply module 1000 comprises two retaining elements 1008, 1010, which, in the first operating condition illustrated in FIG. 4, both are arranged in a retaining position, in which they hold the value note stack 1006 in the value note receiving region 1004. To this end, a respective first side 1012, 1013 of the retaining elements 1008, 1010 contacts the note of value of the value note stack 1006 that is arranged at the front side 1018 facing the supply module 1000.

The notes of value to be supplied to the value note stack 1006 are stacked in a supply region 1016 of the supply module 1000 into a supply stack 1014 and are supplied to the value note receiving region 1004 as a supply stack 1014, such that then, jointly with the value note stack 1006, they form a combined value note stack in the value note receiving region 1004.

In the first operating condition, the supply stack 1014 contacts the retaining elements 1008, 1010 arranged in the retaining position respectively at the side 1020, 1022 facing the first side 1012, 1013. Each of the retaining elements 1008, 1010 is mounted in a respective slider 1024, 1026 and each of them is movable being guided in this slider 1024, 1026 along a movement path predetermined by the slider 1024, 1026 from a retaining position into a supply position illustrated in FIG. 5. Herein, the retaining elements 1008, 1010 a priori are moved in the direction of the arrows P1 and P2, respectively, such that the retaining elements 1008, 1010 are moved in a direction that is oblique to the stacking direction P3, in which the supply stack 1014 is supplied to the value note receiving region 1004. Thus, upon moving the retaining elements 1008, 1010 from the retaining into the supply position, the value note stack 1006 does not have to be moved in the stacking direction P3, such that the entire value note receiving region 1004 is available for receiving notes of value and that with the given dimensions of the value note cassette 16*a*, a maximum number of notes of value is receivable.

The sliders 1024, 1026 are formed to be curved, such that also the retaining elements 1008, 1010 pass through an accordingly curved movement path when being moved from the retaining position into the supply position, such that it is achieved that the supply module 1000 is constructed in a way so as to be as compact as possible.

Further, the supply module 1000 has a supply element 1028 moving the supply stack 1014 into stacking direction P3 for being supplied to the value note receiving region 1004. In the first operating condition illustrated in FIG. 4, the supply element 1028 is arranged in an initial position in which it does not contact the supply stack 1014 and in particular does not press against it. For moving the supply stack 1014 into stacking direction P3, the supply element 1028 is moved translationally into stacking direction P3, such that it supplies the supply stack 1014 into stacking direction P3 to the value note receiving region 1004 of the value note cassette 16*a* and thus to the value note stack 1006. The supply element 1028 comprises in particular a stamp 1030 having a contact surface 1032 via which it contacts the note of value of the supply stack 1014 that faces away from the value note stack 1006.

For supplying the supply stack 1014, at first the stamp 1030 is moved into stacking direction P3 to such an extent that it presses the supply stack 1014 against the retaining elements 1008, 1010. On the other side, the value note stack 1006 received in the value note receiving region 1004 is also pressed against the retaining elements 1008, 1010 by a pressure element 1034 (FIGS. 2 and 3).

Next, the retaining elements 1008, 1010 are moved into the supply position, such that they do no longer retain the value note stack 1006 and do neither contact the value note stack 1006 nor the supply stack 1014. Subsequently, the stamp 1030 is further moved into stacking direction P3, such that it presses the supply value note stack 1014 and the value note stack 1006 now abutting on the supply value note stack 1014 jointly further in the stacking direction P3 against a force of the pressure element 1034 into the value note receiving region 1004. This operating condition is illustrated in FIG. 5 as the second operating condition.

The supply element 1028 herein presses the combined value note stack 1006, 1014 in stacking direction P3 into the value note receiving region 1004 to such an extent that, as viewed in stacking direction P3, a note of value contacting the contact surface 1032 of the stamp 1030 would be arranged behind the retaining elements 1008, 1010, if these retaining elements 1008, 1010 were arranged in the retaining position.

Subsequently, the retaining elements 1008, 1010 are moved back from the supply position into the retaining position along the movement paths. After this has happened, the stamp 1030 is moved back into its initial position, such that the now combined value note stack 1006, 1014 abuts on the first sides 1012, 1013 of the retaining elements 1008, 1010 and is now being held in the value note receiving region 1004. Subsequently, further notes of value are receivable in the supply region 1016 to be stacked to form a new supply stack, which, according to the procedure described above, subsequently is also supplied to the value note receiving region 1004.

The retaining elements 1008, 1010 are in particular moved jointly via a common drive unit from the retaining position into the supply position and from the supply position into the retaining position. The stamp 1030 is movable via the same drive unit or via a separate drive unit.

In an alternative embodiment of the invention, the retaining elements 1008, 1010 can be biased in one of the two positions, respectively, via an elastic element, for example a spring, to be only movable into the respective other position via a drive unit. Moving it back into the biased position in this case is effected by the elastic element. The retaining elements are preferably biased in the retaining position.

In a further alternative embodiment of the invention, the retaining elements 1008, 1010 can be biased in the retaining position, respectively, and be moved upon supply of the supply stack 1014 from the retaining position into the supply position by the supply force applied by the supply element 1028. After the combined value note stack 1006, 1014 has been arranged in the position illustrated in FIG. 5, the retaining elements 1008, 1010 then are automatically moved back from the supply position into the retaining position via the restoring force of the elastic elements, by which they are biased.

In an alternative embodiment of the invention, the movement paths predetermined by the slider 1024, 1026 can also be constructed to be different. In particular, the movement paths can be formed to be linear and be oriented obliquely or transversely to the stacking direction P3.

Further, alternatively only one retaining element 1008, 1010 or more than two retaining elements 1008, 1010 can be provided for retaining the value note stack 1006.

With reference to FIG. 6, by means of movement unit 1040 the retaining element is movable along a movement path obliquely to the stacking direction, in which a note of value to be supplied to the value note stack is supplied to the value note stack, from the retaining position into the supply position and from the supply position into the retaining position. A drive unit 1042 is provided for moving the retaining element along the movement path from the retaining position into the supply position and/or from the supply position into the retaining position. A further drive unit 1044 is provided which moves the supply element for supplying the at least one note of value arranged in the supply region translationally in the stacking direction and presses against a note of value to be supplied. The retaining element is held by an elastic element 1046, in particular at least one spring, in the retaining position, in that the supply element moves the retaining element from the retaining position into the supply position against a restoring force of the elastic element, and in that after the supply of note of value to be supplied or the notes of value to be supplied, the elastic element moves the retaining element back into the retaining position.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

The invention claimed is:

1. A device for handling notes of value, comprising:

at least one cassette receiving region, in which a value note cassette is received for storing notes of value, and a supply module for supplying notes of value to a value note receiving region of the value note cassette for receiving notes of value, wherein the notes of value are receivable in the value note receiving region in the form of a value note stack, wherein the supply module comprises a supply region for supplying notes of value to the value note receiving region, wherein the supply module comprises at least one retaining element, which, in a retaining position, contacts the note of value arranged at the front side of the value note stack facing the supply region and which holds the value note stack in the value note receiving region and which, in a supply position, is arranged such that at least one note of value arranged in the supply region is suppliable to the value note stack, wherein, by means of a movement unit including at least one drive element, the retaining element is movable along a movement path relative to the stacking direction, in which a note of value to be supplied to the value note stack is supplied to the value note stack, from the retaining position into the supply position and from the supply position into the retaining position, and wherein the retaining element is mounted in a slider predefining the movement path and guiding the retaining element while it is being moved.

2. The device according to claim 1, wherein the retaining element separates the value note receiving region from the supply region.

3. The device according to claim 1, wherein the stacking direction is approximately parallel to the normal vector of the plane defined by the value note arranged at the front side of the value note stack.

4. The device according to claim 1, wherein the retaining element is configured to be at least translationally movable.

5. The device according to claim 1, wherein at least a partial region of the movement path is oriented approximately transverse to the stacking direction.

6. The device according to claim 1, wherein the supply module has a supply element for supplying at least one note of value arranged in the supply region to the value note stack and in that a further drive unit is provided, which moves the supply element for supplying the at least one note of value arranged in the supply region-translationally in the stacking direction and presses against a note of value to be supplied.

7. The device according to claim 6, wherein at an end region of the value note receiving region, which is located opposite to the supply region, a pressure element is arranged, that contacts the note of value arranged at the front side of the value note stack facing away from the supply region and presses the value note stack against the retaining element arranged in the retaining position.

8. The device according to claim 7, wherein the pressure element presses the value note stack against the retaining element in a direction opposite to the stacking direction.

9. The device according to claim 8, wherein the further drive unit moves the supply element such that it presses the note of value to be supplied or the notes of value to be supplied, respectively, against the retaining element with a supply force and in that the supply force causes the movement of the retaining element from the retaining position into the supply position.

10. The device according to claim 9, wherein the retaining element is held by an elastic element, in particular at least one spring, in the retaining position, in that the supply element moves the retaining element from the retaining position into the supply position against a restoring force of the elastic element, and in that after the supply of a note of value to be supplied or the notes of value to be supplied, the elastic element moves the retaining element back into the retaining position.

11. The device according to claim 7, wherein a control unit a priori controls the further drive unit such that the latter moves the supply element in the stacking direction to such an extent that it presses the note of value to be supplied or the notes of value to be supplied, respectively, against the retaining element, in that subsequently, the control unit controls the drive unit such that the latter moves the retaining element from the retaining position into the supply position, and in that, then, the control unit controls the further drive unit such that the latter transports the note of value or the notes of value, respectively, further in the stacking direction from the supply region to the value note receiving region and presses it against the front side of the value note stack.

12. The device according to claim 11, wherein after supply of the note of value to be supplied or the notes of value to be supplied, respectively, the control unit controls the further drive unit such that the latter moves the supply element in a direction opposite to the stacking direction back to an initial position or controls the one drive unit such that the latter moves the retaining element from the supply position into the retaining position.

13. The device according to claim 1, wherein the supply module comprises at least one further retaining element, which, in a retaining position, contacts the note of value arranged at the front side of the value note stack facing the supply region and holds the value note stack in the value note receiving region and which, in a supply position is arranged such that at least one note of value arranged in the supply region is suppliable to the value note stack, and which along a further movement path is movable in a direction oblique to the stacking direction from the retaining position into the supply position and from the supply position into the retaining position.

* * * * *